US007011529B2

(12) United States Patent
Oldfield et al.

(10) Patent No.: US 7,011,529 B2
(45) Date of Patent: Mar. 14, 2006

(54) HERMETIC GLASS BEAD ASSEMBLY HAVING HIGH FREQUENCY COMPENSATION

(75) Inventors: William W. Oldfield, Redwood City, CA (US); Maurice W. Moberg, Los Altos, CA (US)

(73) Assignee: Anritsu Company, Morgan Hill, CA (US)

( * ) Notice: Subject to any disclaimer, the term of this patent is extended or adjusted under 35 U.S.C. 154(b) by 0 days.

(21) Appl. No.: 10/790,391

(22) Filed: Mar. 1, 2004

(65) Prior Publication Data

US 2005/0191869 A1 Sep. 1, 2005

(51) Int. Cl.
*H01R 12/00* (2006.01)

(52) U.S. Cl. ..... 439/63; 333/33

(58) Field of Classification Search ..... 439/63, 439/387, 581, 30, 260; 333/260, 33, 34, 333/245–247, 182; 257/664, 728
See application file for complete search history.

(56) References Cited

U.S. PATENT DOCUMENTS 4,153,885 A * 5/1979 Bacher ..... 333/28 R
4,259,684 A 3/1981 Dean ..... 257/664
4,724,409 A 2/1988 Lehman ..... 333/260
4,951,011 A * 8/1990 Heckaman et al. ..... 333/33
5,563,562 A * 10/1996 Szwec ..... 333/260
5,576,675 A 11/1996 Oldfield ..... 333/260
5,696,474 A 12/1997 Spivey ..... 333/245
5,928,000 A * 7/1999 Rudisill et al. ..... 439/63
5,959,514 A 9/1999 Smith ..... 333/260
6,154,103 A 11/2000 Scharen ..... 439/63
6,604,949 B1 8/2003 Oldfield ..... 333/995
6,758,680 B1 * 7/2004 Duquerroy et al. ..... 439/63
6,863,548 B1 * 3/2005 Coccioli et al. ..... 439/101

* cited by examiner

*Primary Examiner*—Michael C. Zarroli
(74) *Attorney, Agent, or Firm*—Fliesler Meyer LLP

(57) ABSTRACT

Methods and devices in accordance with the present invention can comprise forming an electrical feed-through assembly to provide a hermetic seal in a coaxial connector. In one embodiment, the electrical feed-through assembly comprises a conductive insert having a bore, a dielectric insert positioned within the bore having a first diameter sized such that an impedance of the dielectric insert is a target impedance, the dielectric insert having a center conductive pin extending there-through, and an air dielectric positioned within the bore, the air dielectric having a second diameter sized such that an impedance of the air dielectric is the target impedance, a portion of the air dielectric extending into the dielectric insert, wherein the portion of the air dielectric extending into the dielectric insert is a compensation gap.

24 Claims, 8 Drawing Sheets

HERMETIC GLASS BEAD ASSEMBLY HAVING HIGH FREQUENCY COMPENSATION

TECHNICAL FIELD

The present invention relates generally to microwave connectors, and more specifically to microwave connectors using dielectric inserts or beads for hermetic sealing.

BACKGROUND OF THE INVENTION

As operational frequencies of microwave components and subsystems have increased, performance of electrical feed-through connections between microwave integrated circuits and coaxial connectors, waveguides, etc., has become critical. With the advent of multi-function monolithic microwave integrated circuit (MMIC) chips, impedance matching and hermeticity—not normally required at lower frequencies—have become important and tightly toleranced design criteria.

Hermeticity in microwave packages is commonly achieved by use of one or more dielectric inserts or beads. The dielectric inserts themselves are hermetic and can either be molded or fired into a sleeve, which is then soldered into a package. If the sleeve is correctly soldered into the package, the package can be hermetically sealed. Alternatively, a dielectric insert can be molded or fired directly into the package to reduce manufacturing cost while providing greater reliability.

For high frequency microwave applications, features surrounding the dielectric insert are critical for good RF performance and such features must be tightly toleranced during manufacturing. For MMICs, coaxial connector assembly components provide electrical transition and impedance matching between a coaxial transmission line of a coaxial connector and a microstrip transmission line connected to the MMICs. To achieve impedance matching, connector components include impedance compensation. Impedance compensation can include, for example, an air dielectric between the microstrip and a coaxial connector housing, and an additional compensation gap between the dielectric insert and the air dielectric. Integrating a dielectric insert into a package and forming an air dielectric and compensation gap between the dielectric insert and a package housing becomes more difficult as components shrink in size and tolerances of features tighten.

BRIEF DESCRIPTION OF THE DRAWINGS

Further details of embodiments of the present invention are explained with the help of the attached drawings in which.

DETAILED DESCRIPTION

Figure 1A:
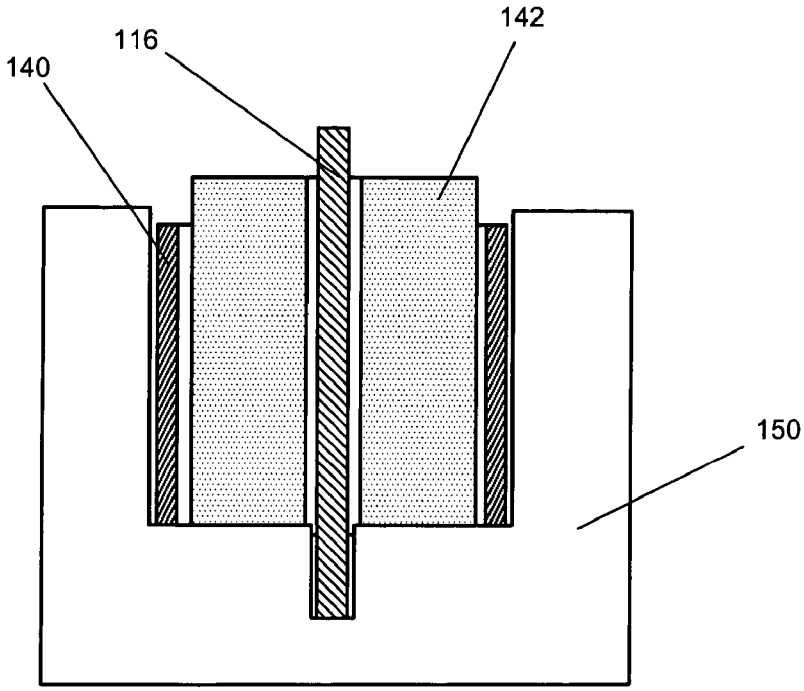
FIG. 1A (Prior Art)
FIG. 1A is a cross-section of a glass pellet, a sleeve, and a center conductor pin positioned on a fixture for forming a typical glass bead in accordance with the prior art.
Figure 1B:
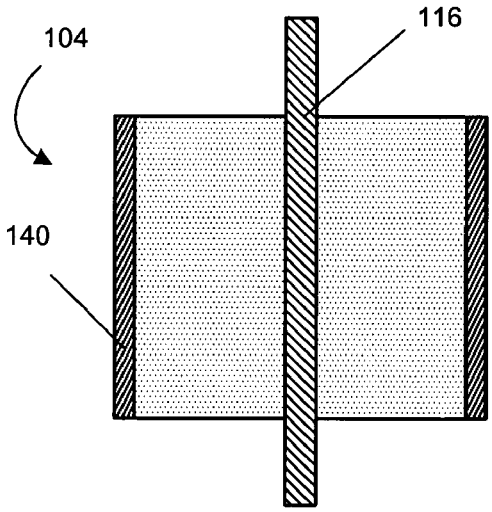
FIG. 1B (Prior Art)
FIG. 1B is a cross-section of the glass bead of FIG. 1A after firing.

Coaxial connector assemblies typically include an electrical feed-through connection mounted in a package housing and comprising an assembly including a dielectric insert supporting a center conductor pin, for example in shown in FIGS. 1A and 1B. The dielectric insert is hereinafter referred to as a glass bead; however, it will be appreciated that the dielectric insert need not comprise glass—for example, the dielectric insert can comprise a ceramic or a plastic (e.g., Teflon). Further, the dielectric insert need not be bead shaped. One of ordinary skill in the art can appreciate the myriad different materials with which the dielectric insert can be formed and the myriad different shapes in which the dielectric insert can be formed.

Glass beads are commonly used in microwave housings that benefit from hermetic sealing. A hermetic glass bead 104 typically comprises a sleeve 140 which is soldered into a conductive insert. A traditional method of molding glass beads 104 can include a center conductor pin 116 and a sleeve 140, both comprising Kovar, and a glass pellet 142. Kovar is an iron based alloy comprising nickel and cobalt. The chemistry of Kovar is closely controlled so as to result in a material having a low, uniform thermal expansion characteristic substantially similar to that of glass. Further, glass will stick to a Kovar surface to form a hermetic seal. During manufacture of a typical glass bead 104, the glass pellet 142 is positioned in the sleeve 140 and the center conductor pin 116 is positioned within the glass pellet 142. As shown in FIG. 1A, a fixture 150 holds the parts in place. The fixture 150 can be made of carbon, a carbon alloy, or some other material having similar properties (e.g., a high melting temperature and low coefficient of thermal expansion). The parts are placed in a furnace and the glass is melted and flows into the final form by gravity. The finished part is shown in FIG. 1B. As described above, glass beads 104 can comprise materials other than glass, and need not be formed in the manner described. Further, the center conductor pin 116 and sleeve 140 can comprise materials other than Kovar, for example a material having a substantially similar thermal expansion characteristic as a material chosen as a dielectric insert. One of ordinary skill in the art can appreciate the myriad different techniques for manufacturing a dielectric insert, such as a glass bead.

Figure 2:
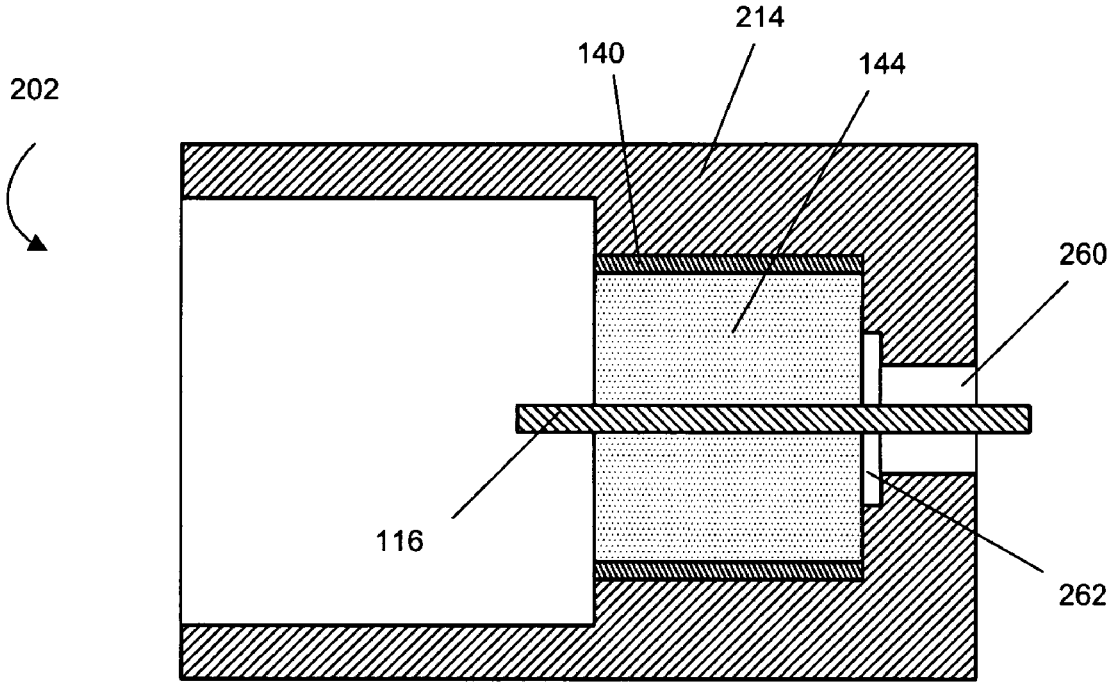
FIG. 2 (Prior Art)
FIG. 2 is a cross-section of the glass bead of FIG. 1B mounted in a conductive insert to form a glass bead assembly in accordance with the prior art.

As shown in FIG. 2, for high frequency applications a glass bead 104 is mounted in a conductive insert 214 to form a glass bead assembly (also referred to herein as an electrical feed-through connection) 202. The conductive insert 214 is generally cylindrical in shape, having a proximal end and a distal end, wherein the proximal end is adjacent to a housing in which a microstrip substrate is located (as shown below in FIG. 3). The conductive insert 214 includes a bore varying in diameter along the length of the conductive insert 214. A first portion of the bore receives a glass bead 104 and is sized such that a characteristic impedance of the glass bead matches a characteristic impedance of a coaxial connector. The characteristic impedance of a dielectric is given by the equation:

$$z_o = \frac{60}{\sqrt{Er}} \mathrm{Ln}\left(\frac{D_o}{D_i}\right)$$

where Er is the relative permittivity of the dielectric (i.e., the dielectric constant), $D_o$ is the diameter of an outer conductor (e.g., the inner surface of the bore) and $D_i$ is the diameter of an inner conductor (e.g., the center conductor pin). In a typical microwave connector, the characteristic impedance of the coaxial connector is 50 Ω. The first portion of the bore is sized such that $z_o$ is 50 Ω when a glass dielectric is positioned in the first portion. In other embodiments the characteristic impedance can be more or less than 50 Ω.

An entry into a package housing is preferably an air dielectric 260. A second portion of the bore comprises the air dielectric 260, and is sized such that the impedance of the air dielectric 260 matches the characteristic impedance of the coaxial connector (e.g., 50 Ω). Because the dielectric constant of air is lower than that of glass, the second portion of the bore is smaller in diameter than the first portion. Where the size of the coax varies—e.g., with a change in air dielectric sizes or where transitioning from a glass dielectric to an air dielectric—there is excess fringing capacitance which can cause mismatch reflection. A short section of higher impedance (inductive) line can be used to balance out the fringing capacitance and minimize the effect of the transition. By minimizing this effect, impedance matching can be optimized, allowing a signal to be efficiently coupled with circuitry of a package housing with reduced return loss. The inductive portion of the electrical feed-through, or compensation gap 262, is positioned between the glass dielectric and air dielectric and sized such that the fringing capacitive effect is minimized. As shown, the portion of the bore forming the compensation gap 262 has a diameter slightly larger than that of the air dielectric to produce a higher impedance. The glass bead 104 located within the first portion includes a center conductor pin 116, supported by the glass bead 104. The center conductor pin 116 further extends through the compensation gap 262 and air dielectric 260. The glass bead 104 allows for the formation of a hermetic seal around the center conductor pin 116.

Figure 3:
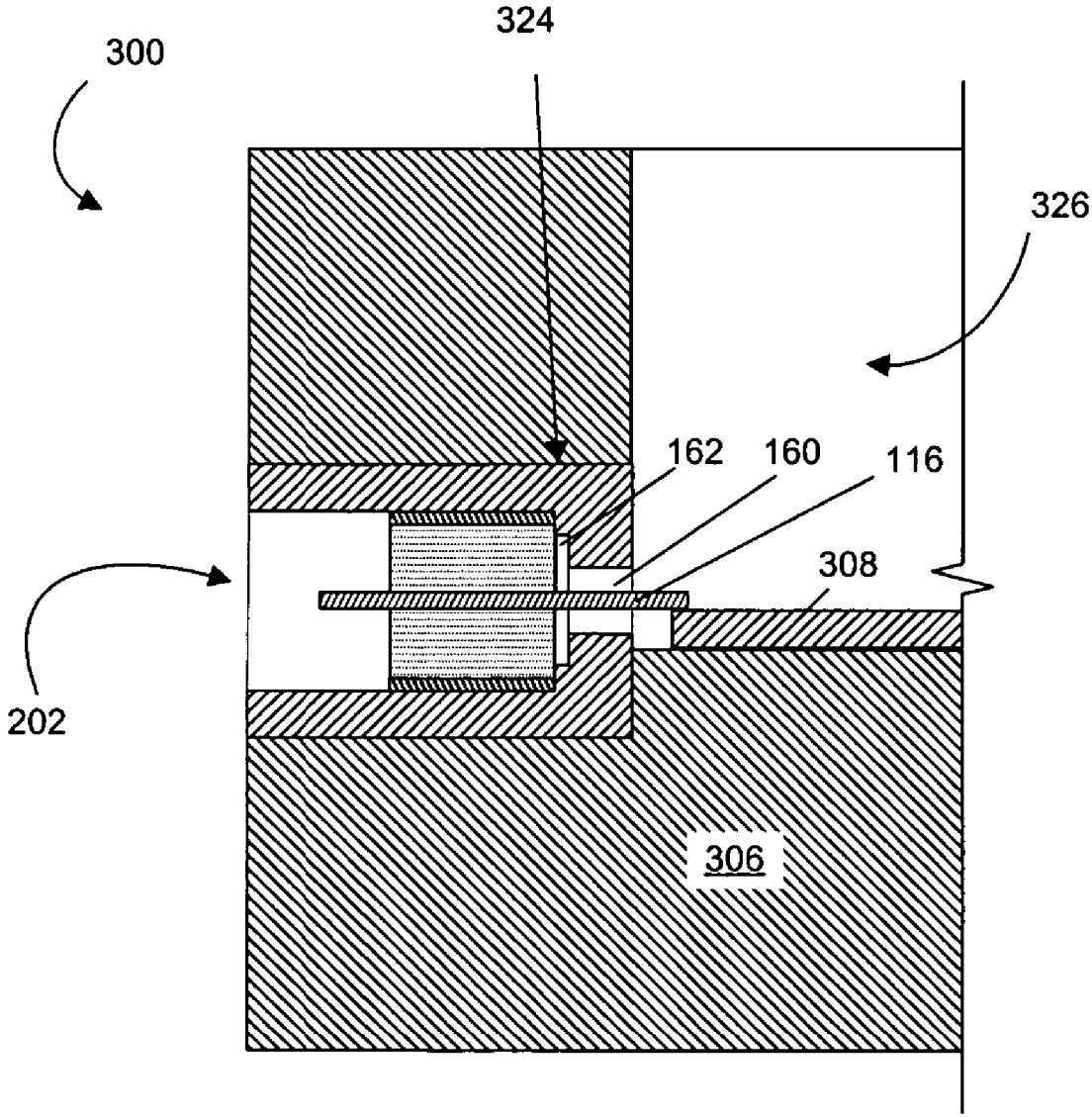
FIG. 3 is a partial cross-section of an exemplary coaxial connector assembly including a glass bead assembly.

The air dielectric 260 should be as small as possible in order to minimize mismatch when connecting to a small high frequency microstrip mounted in the housing (as shown in FIG. 3). For satisfactory high frequency performance, an appropriate transition can be incorporated into the glass bead assembly by mounting the glass bead 104 (e.g., by soldering) in the conductive insert 214 having a bore machined, cast, extruded, etc. to include the air dielectric 260 and compensation gap 262. The conductive insert 214 typically comprises a material having a high coefficient of thermal expansion (e.g., brass or copper), thereby allowing the sleeve 140 of the glass bead to be easily and suitably soldered to the conductive insert 214

FIG. 3 illustrates an exemplary coaxial connector assembly 300 in which an electrical feed-through connection 202 is used. The electrical feed-through connection 202 is mounted in a package housing 306 and positioned such that the center conductor pin 116 is in electrical communication with the microstrip substrate 308 located within the housing 306. The housing 306 includes a cavity 324 for receiving the conductive insert of the electrical feed-through connection 202. To ensure a good connection between the electrical feed-through connection 202 and the housing 306, the conductive insert is fixedly attached to the housing 306. For example, the conductive insert can be soldered into the cavity 324 of the housing 306 or connected to the housing 306 by bolts. The housing further contains a second cavity 326 for associated circuitry.

Figure 4A:
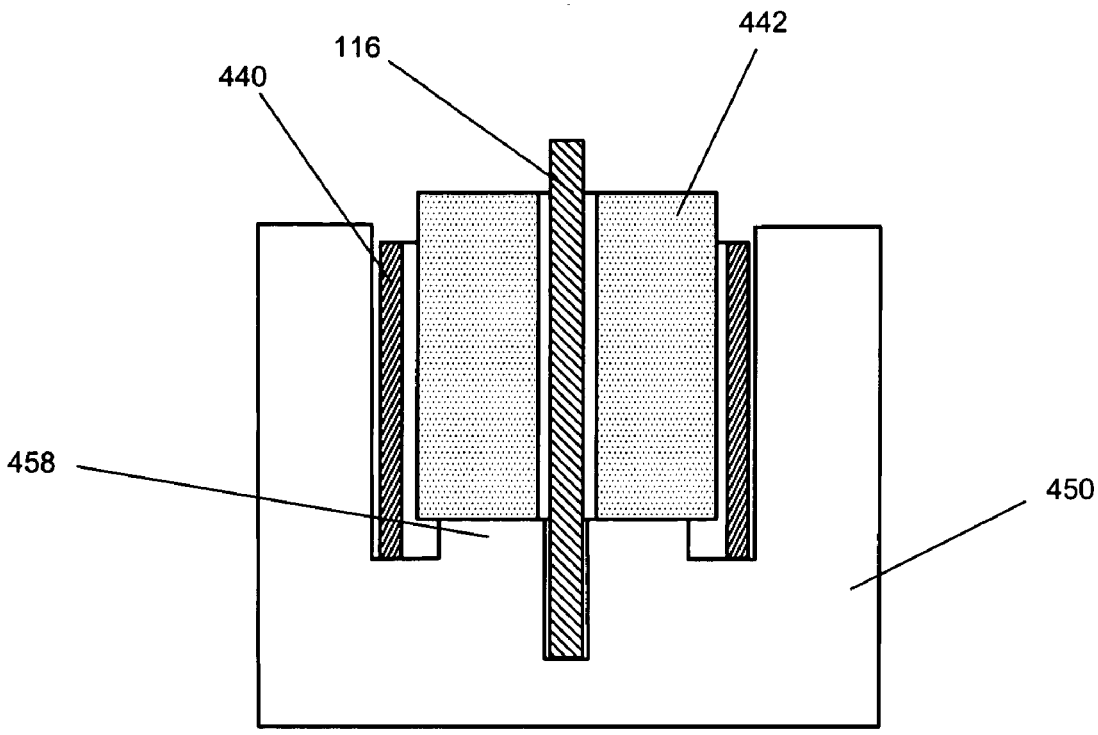
FIG. 4A is a cross-section of a glass bead in accordance with one embodiment of the present invention having a molded compensation step.
Figure 4B:
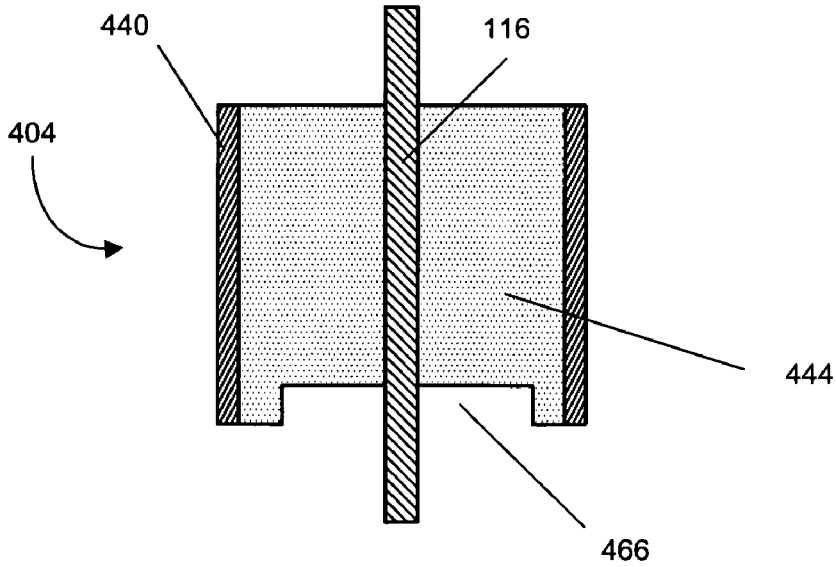
FIG. 4B is a cross-section of the glass bead of FIG. 4A after firing.

The process of separately forming the glass bead and mounting the glass bead into a conductive insert machined, extruded, or otherwise formed to include an air dielectric and compensation gap can be expensive. FIGS. 4A and 4B illustrate one embodiment of a hermetic glass bead for use in a glass bead assembly in accordance with the present invention which can eliminate the need for a machined compensation step, for example as in the conductive insert of FIG. 2. The hermetic glass bead 404 can comprise a sleeve 440 which can be soldered into a conductive insert. As described above in reference to FIG. 1, a method of molding glass beads 404 can include a center conductor pin 116, a sleeve 440, and a glass pellet 442. The center conductor pin 116 and the sleeve 440 can comprise Kovar, in one embodiment, or alternatively some other material having similar thermal expansion coefficient characteristics as the dielectric material used. During manufacturing, the parts are positioned as shown in FIG. 4A on a fixture 450 in accordance with one embodiment of the present invention having a compensation step 458 positioned concentrically with the sleeve 440 and the center conductor pin 440. The compensation step 458 comprises a substantially cylindrical portion having a diameter smaller than the inner diameter of the sleeve 440. When fired, glass fills the gap between the compensation step and the inner surface of the sleeve 440, as shown in FIG. 4B, forming a glass bead 404 having an air/glass compensation gap 466. The glass bead 404 can be fixedly connected with a conductive insert (e.g., by soldering) to form a hermetic seal. The conductive insert can include an air dielectric formed therein, or alternatively, the air dielectric can be formed within the packaging housing. As described above, glass beads can comprise materials other than glass, and need not be formed in the manner described. Further, the compensation step can be sized such that an inductance of the resulting air/glass compensation gap can provide a desired impedance. One of ordinary skill in the art can appreciate the myriad different techniques for manufacturing a dielectric insert, such as a glass bead.

Figure 5A:
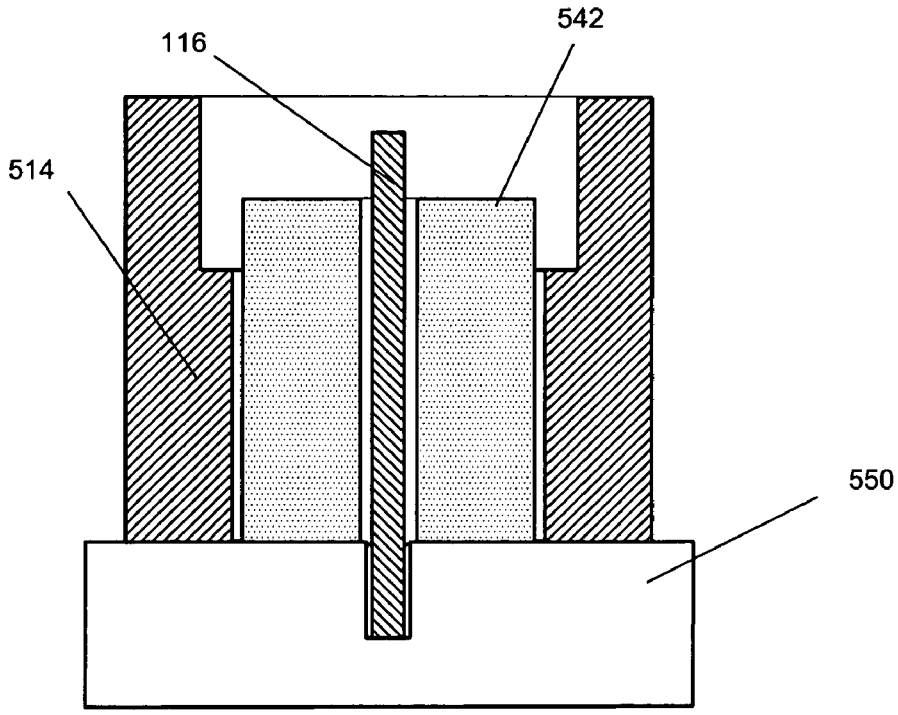
FIG. 5A is a cross-section of a glass pellet, a conductive insert and a center conductor pin positioned on a fixture such that a glass bead assembly in accordance with one embodiment of the present invention can be formed.
Figure 5B:
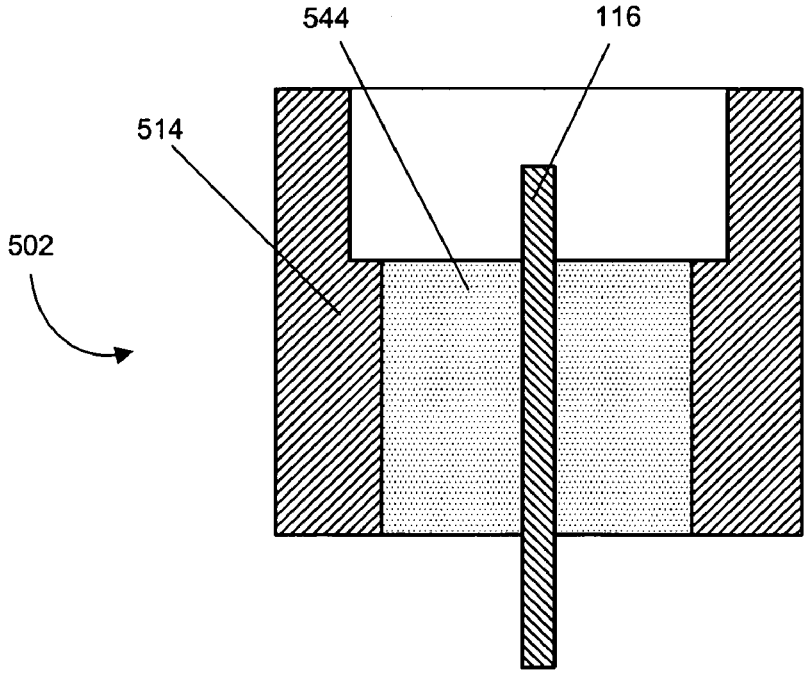
FIG. 5B is a cross-section of the glass bead assembly of FIG. 5A after firing.

In order to further reduce manufacturing expense, a glass bead can be molded directly into the conductive insert, as shown in FIGS. 5A and 5B. The glass bead is not easily molded into the conductive insert of FIG. 2, because a flowing glass fills the air dielectric and compensation gap during molding. In one embodiment of a glass bead assembly in accordance with the present invention, a glass bead assembly 502 can be formed by directly firing a glass pellet 542 within a conductive insert 514. The conductive insert 514 comprises a material having a high melting temperature and preferably a low coefficient of expansion (e.g., Kovar). The conductive insert 514, glass pellet 542 and center conductor pin 116 are positioned on a fixture 550, and placed in a furnace. Thus, a glass bead assembly having no transition between a package housing cavity and a glass dielectric 544 is formed, as shown in FIG. 5B. Where no transition is formed within the glass bead assembly, transition and compensation is incorporated into a package housing, for example by machining the package housing.

Figure 6A:
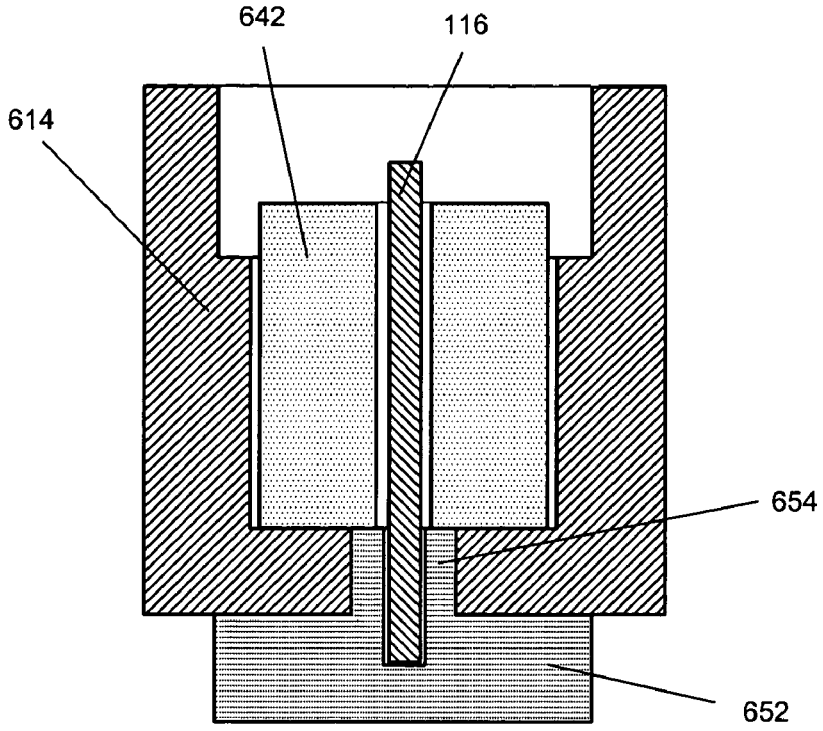
FIG. 6A is a cross-section of a glass pellet, a conductive insert and a center conductor pin positioned on a fixture having a plug such that a glass bead assembly in accordance with an alternative embodiment of the present invention can be formed.
Figure 6B:
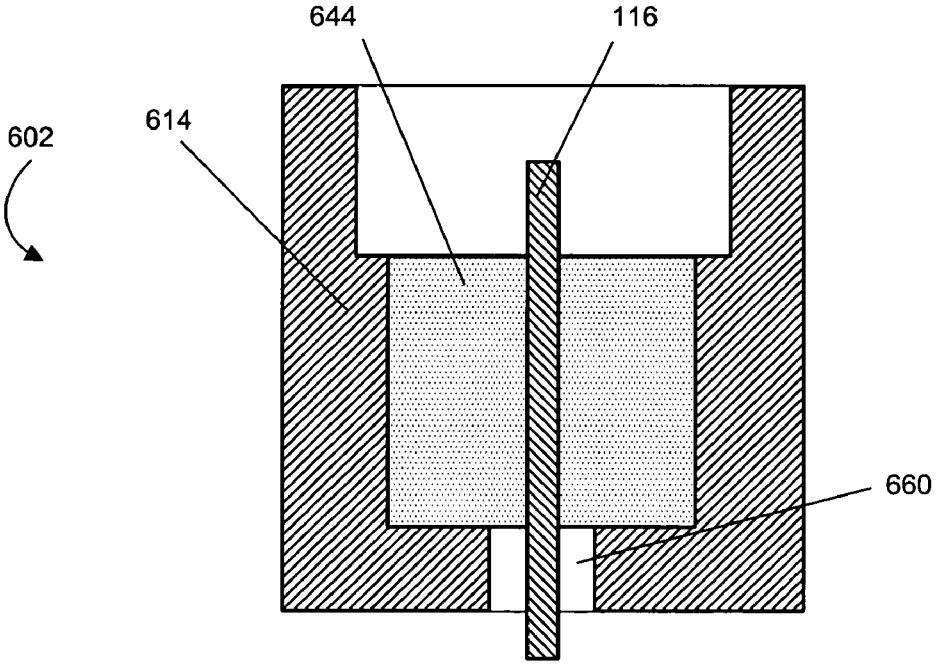
FIG. 6B is a cross-section of the glass bead assembly of FIG. 6A after firing.

A method of forming a glass to air transition without compensation in accordance with an alternative embodiment of the present invention is shown in FIGS. 6A and 6B. The conductive insert 614 includes a bore having a varying diameter such that a medium formed within each portion of the bore includes an impedance substantially similar to the impedance of the coaxial connector. A plug 654 is positioned to at least partially fill an air dielectric section while the glass is molded or fired into the conductive insert 614. The plug 654 can comprise high temperature carbon composite or some other material providing similar performance during firing. The plug 654 can be integrally formed or connected with a fixture 652, as described above in reference to FIGS. 2 and 4, or the plug 654 can be removably inserted into the conductive insert 614 separately from the fixture 652. Further, the plug 654 can include a cavity for receiving a center conductor pin 116 for positioning during firing. The cavity can be formed such that the center conductor pin 116 bottoms out in the plug 654 in a very precisely toleranced hole, so that the center conductor pin 116 is concentrically positioned with respect to both the glass bead 642 and the air dielectric 660. Alternatively, the center conductor pin 116 can be free floating so that the pin can be sheared and deburred subsequent to forming the electrical feed-through connection. As will be appreciated by one of ordinary skill in the art, there are numerous plug designs, any of which can be applied to methods and devices in accordance with the present invention.

As shown in FIG. 6A, during manufacturing, the center conductor pin 116 can be positioned within the plug 654, and the plug 654 can be positioned within a portion of the conductive insert 614 in which the air dielectric 660 is to be formed. A glass pellet 642 can be positioned within the bore of the conductive insert 614. As described above, the parts are then placed within a furnace to liquefy the glass pellet 642 such that the glass pellet 642 forms a seal around the center conductor pin 614 and adheres to the walls of the conductive insert 614. The plug can then be removed, resulting in a glass bead assembly 602 as shown in FIG. 6B. The glass bead assembly 602 includes a glass dielectric 644 to air dielectric 660 transition that may result in unsatisfactory performance, particularly at higher frequencies.

Figure 7A:
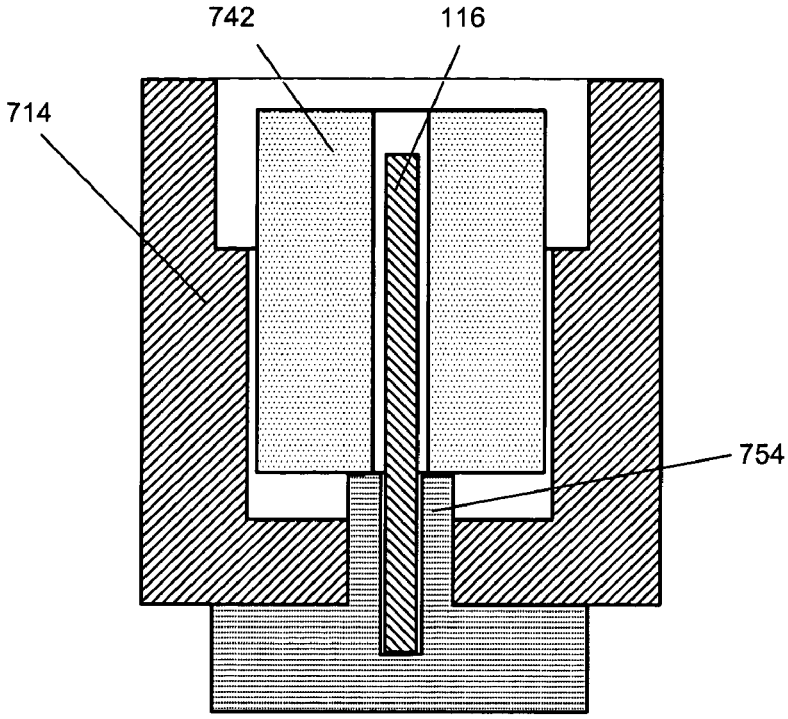
FIG. 7A is a cross-section of a glass pellet, a conductive insert and a center conductor pin positioned on a fixture having a plug such that a glass bead assembly in accordance with still another embodiment of the present invention can be formed.
Figure 7B:
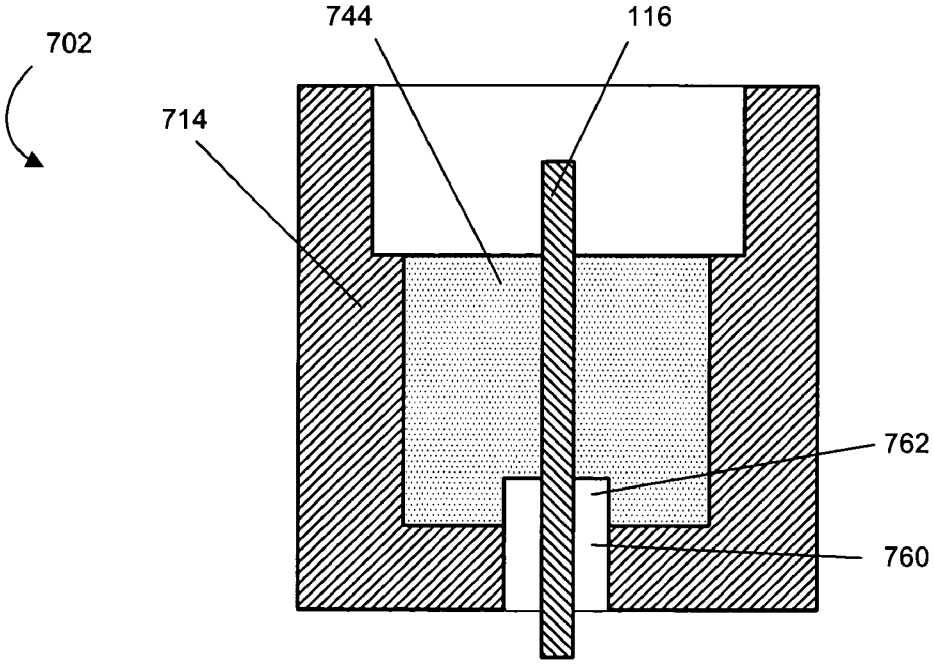
FIG. 7B is a cross-section of the glass bead assembly of FIG. 7A after firing.

A method and device in accordance with still another embodiment of the present invention is illustrated in cross-section in FIGS. 7A and 7B. A conductive insert 714 includes a bore varying in diameter from a distal end of the conductive insert 714 to a proximal end of the conductive insert 714. As described above, a plug 754 is positioned within a portion of the bore for forming an air dielectric 760. As shown in FIG. 7A, the plug 754 is further extended into a portion of the conductive insert 714 such that an air/glass compensation gap 762 is formed between the air dielectric 760 and the glass bead 744. The characteristic impedance of the air/glass compensation gap 762 formed in this manner can be described by the equation:

$$z_o = \frac{60}{\sqrt{Er_{glass}}}\mathrm{Ln}\left(\frac{D_o}{D_i}\right) + \frac{60}{\sqrt{Er_{air}}}\mathrm{Ln}\left(\frac{D_i}{D_i}\right)$$

where $Er_{glass}$ is the dielectric constant of the glass bead, $Er_{air}$ is the dielectric constant of the air within the compensation gap 762, and $D_i$ is the diameter of the inner surface of the glass bead within the compensation gap 762. As will be readily understood, the impedance will be greater in the compensation gap 762 than in either the glass bead 744 or the air dielectric 760.

As shown in FIG. 7A, to form the compensation gap 762, the plug 754 is either repositioned toward the distal end of the conductive insert 714 or the plug 754 is extended in length such that the plug 754 extends from the air dielectric portion into a portion of the bore of the conductive insert 714 having a diameter sized for the glass dielectric As described above, the center conductor pin 116 is positioned within the plug 754, a glass pellet is positioned around the center pin conductor 116, and the parts are positioned in a furnace. As shown in FIG. 7B, the glass pellet 742 liquefies and flows into the spaces not occupied by the plug 754. As the plug 754 is removed from the glass bead assembly 702 an air dielectric 760 is formed. Further, a displaced portion of the glass bead 744 forms a high impedance inductive section (i.e., the air/glass compensation gap 762). The impedance of this section is typically not as high as the impedance of the compensation gap of the glass bead assembly shown in FIG. 2. The section can be lengthened to obtain the required inductance, but the dielectric mismatch is not fully minimized. However, the assembly can provide satisfactory results at a reduced cost to manufacture.

The plug described above can be shaped, as well as sized, such that the resulting inductive section (the air/glass compensation gap) provides a desired inductance, and therefore satisfactory impedance matching between the glass dielectric and the air dielectric. For example, in some embodiments, it may be beneficial to create a slightly concave recess within the glass bead. In still other embodiments, a diameter of the portion of the plug extending into the glass bead can be smaller than the diameter of the air dielectric. The resulting air dielectric within the glass bead provides a high impedance, inductive compensation section. One of ordinary skill in the art can appreciate the numerous variations in the shape of the high impedance inductive section.

Figure 8A:
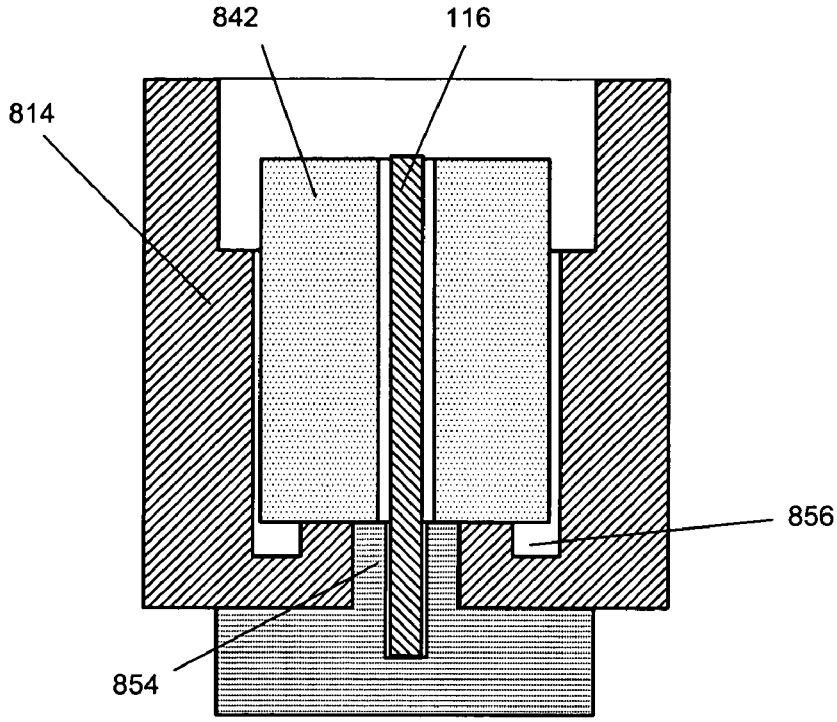
FIG. 8A is a cross-section of a glass pellet, a conductive insert and a center conductor pin positioned on a fixture having a plug such that a glass bead assembly in accordance with still another embodiment of the present invention can be formed.
Figure 8B:
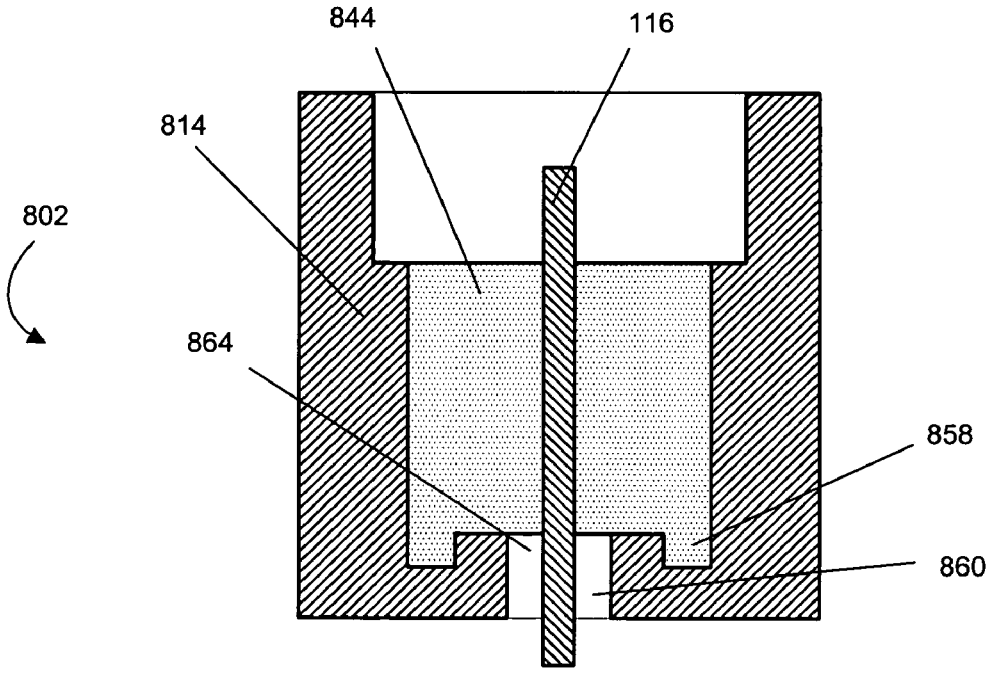
FIG. 8B is a cross-section of the glass bead assembly of FIG. 8A after firing.

A method and device in accordance with still another embodiment of the present invention is illustrated in FIGS. 8A and 8B. As described in regards to FIGS. 6A–7B, the conductive insert 814 includes a bore varying in diameter from a distal end of the conductive insert 814 to a proximal end of the conductive insert 814. However, the bore further includes a cavity or recess 856 extended from a portion of the bore in which a glass bead 844 is partially formed. As shown in FIG. 8A, during manufacturing a plug 854 is positioned within a portion of the bore to form the air dielectric 860. A center conductor pin 116 is then positioned within the plug 854, and a glass pellet 842 is positioned around the center pin conductor 116. As described above, the parts are placed in a furnace. As the glass pellet 842 liquefies, glass occupies space not occupied by the plug 854, including the cavity 856. As the plug 854 is removed from the bearing assembly an air dielectric 860 is formed. The glass choke 858 forms a high impedance section in series with a portion of the air dielectric 864. Because the conductive insert 814 is slightly complicated by the addition of the choke 858, this method can be slightly more costly and provides less satisfactory results than the embodiment described above. Though the dielectric mismatch is not fully minimized, the assembly can provides satisfactory results at a reduced cost to manufacture over a typical glass bead assembly.

It should be noted that glass beads and glass bead assemblies formed in accordance with embodiments of the present invention can be used in the coaxial connector assembly as described above in regards to FIG. 3. Further, glass beads and glass bead assemblies formed in accordance with embodiments of the present invention can be used in any electrical feed-through connection wherein a hermetic seal is desired, including coaxial connector assemblies having different components, packages, and methods of assembly as those described above.

The foregoing description of preferred embodiments of the present invention has been provided for the purposes of illustration and description. It is not intended to be exhaustive or to limit the invention to the precise forms disclosed. Many modifications and variations will be apparent to one of ordinary skill in the relevant arts. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

An embodiment of an electrical feed-through assembly for providing a hermetic seal in a coaxial connector in accordance with the present invention comprises a conductive insert having a bore, a dielectric insert positioned within the bore having a first diameter sized such that an impedance of the dielectric insert is a target impedance, the dielectric insert having a center conductor pin extending therethrough, and an air dielectric positioned within the bore. The air dielectric has a second diameter sized such that an impedance of the air dielectric is the target impedance. A portion of the air dielectric extends into the dielectric insert, and forms a compensation gap.

The invention claimed is:

1. An electrical feed-through assembly to provide a hermetic seal in a coaxial connector, comprising:

a conductive insert having a bore;

a dielectric insert positioned within the bore having a first diameter sized such that an impedance of the dielectric insert is a target impedance;

a center conductor pin extending through the dielectric insert;

an air dielectric positioned within the bore having a second diameter sized such that an impedance of the air dielectric is the target impedance; and a compensation gap positioned between the dielectric insert and the air dielectric, the compensation gap having an impedance larger than the target impedance;

wherein the compensation gap is a recess formed within the dielectric insert.

2. The electrical feed-through assembly of claim 1, wherein the dielectric insert comprises a glass bead.

3. The electrical feed-through assembly of claim 1, wherein the conductive insert comprises a conductive metal.

4. The electrical feed-through assembly of claim 3, wherein the conductive insert comprises an iron-nickel-cobalt alloy.

5. The electrical feed-through assembly of claim 1, further comprising a sleeve positioned within the bore, wherein the dielectric insert is formed in the sleeve.

6. The electrical feed-through assembly of claim 5, wherein the sleeve is positioned within the bore by soldering.

7. The electrical feed-through assembly of claim 5, wherein the dielectric insert is formed by molding.

8. The electrical feed-through assembly of claim 1, wherein the dielectric insert is formed in the bore.

9. The electrical feed-through assembly of claim 8, wherein the dielectric insert is formed by molding.

10. An electrical feed-through assembly to provide a hermetic seal in a coaxial connector, comprising:

a conductive insert having a bore and a cavity within the bore, the cavity surrounding a portion of the bore;

a dielectric insert positioned within the bore having a diameter sized such that an impedance of a portion of the dielectric insert is a target impedance, the dielectric insert extending into the cavity;

a center conductor pin extending through the dielectric insert;

an air dielectric positioned within the bore, the air dielectric having a diameter sized such that an impedance of a portion of the air dielectric is the target impedance; and a compensation gap formed between the glass dielectric and the air dielectric, such that at least a portion of the compensation gap is surrounded by the cavity.

11. The electrical feed-through assembly of claim 10, wherein the dielectric insert comprises a glass bead.

12. The electrical feed-through assembly of claim 10, wherein the conductive insert comprises a conductive metal.

13. The electrical feed-through assembly of claim 10, wherein the conductive insert comprises an iron-nickel-cobalt alloy.

14. The electrical feed-through assembly of claim 10, wherein the dielectric insert is formed within the bore.

15. The electrical feed-through assembly of claim 14, wherein the dielectric insert is formed by molding.

16. The electrical feed-through assembly of claim 10, wherein an impedance of the compensation gap is higher than the target impedance.

17. A dielectric insert assembly to provide a hermetic seal in a coaxial connector, comprising:

a substantially cylindrical sleeve having a first inner diameter, the substantially cylindrical sleeve adapted to be arranged within a conductive insert such that the dielectric insert assembly and the conductive insert form an electrical feed-through connection;

a dielectric portion disposed within the substantially cylindrical sleeve;

wherein a distal end of the dielectric portion is substantially aligned with a distal end of the substantially cylindrically sleeve;

a center conductor pin extending through the dielectric portion; and a compensation gap extending into the distal end of the dielectric portion, the compensation gap having a second diameter smaller than the first inner diameter;

wherein the dielectric portion is one of a glass, a ceramic, and a plastic.

18. The dielectric insert assembly of claim 17, wherein the dielectric insert comprises a glass bead.

19. The dielectric insert assembly of claim 17, wherein the sleeve comprises a conductive metal.

20. The dielectric insert assembly of claim 17, wherein the dielectric insert is formed by molding.

21. The electrical feed-through assembly of claim 17, wherein: an impedance of a portion of the dielectric insert is a target impedance; an impedance of the compensation gap is higher than the target impedance.

22. An electrical feed-through assembly to provide a hermetic seal in a coaxial connector, comprising:

a conductive insert having a bore and a cavity extending from the bore;

a dielectric insert disposed within the bore, the dielectric insert having a diameter sized such that an impedance of a portion of the dielectric insert is a target impedance;

a choke extending from the dielectric insert and disposed within the cavity;

an air dielectric positioned within the bore, the air dielectric having a diameter sized such that an impedance of a portion of the air dielectric is the target impedance; and a center conductor pin extending through the dielectric insert and the air dielectric;

wherein at least a portion of the air dielectric is coincident with the choke along the center conductor pin; and wherein the portion of the air dielectric coincident with the choke along the center conductor pin is a compensation gap.

23. A coaxial connector assembly comprising:

a package housing;

a microstrip disposed within the package housing;

an electrical feed-through assembly mounted in the package housing, the electrical feed-through assembly including:

a conductive insert having a bore, a dielectric insert positioned within the bore having a first diameter sized such that an impedance of the dielectric insert is a target impedance, a center conductor pin extending through the dielectric insert, an air dielectric positioned within the bore having a second diameter sized such that an impedance of the air dielectric is the target impedance, and a compensation gap positioned between the dielectric insert and the air dielectric, the compensation gap having an impedance larger than the target impedance, wherein the compensation gap is a recess formed within the dielectric insert;

wherein the center conductor pin is in electrical communication with the microstrip.

24. A coaxial connector assembly comprising:

a package housing;

a microstrip disposed within the package housing;

an electrical feed-through assembly mounted in the package housing, the electrical feed-through assembly including:

a conductive insert having a bore and a cavity extending from the bore, a dielectric insert disposed within the bore, the dielectric insert having a diameter sized such that an impedance of a portion of the dielectric insert is a target impedance, a choke extending from the dielectric insert and disposed within the cavity;

an air dielectric positioned within the bore, the air dielectric having a diameter sized such that an impedance of a portion of the air dielectric is the target impedance, and a center conductor pin extending through the dielectric insert and the air dielectric, wherein at least a portion of the air dielectric is coincident with the choke along the center conductor pin, wherein the portion of the air dielectric coincident with the choke is a compensation gap; wherein the center conductor pin is in electrical communication with the microstrip.

* * * * *